US007062870B1

(12) United States Patent
You

(10) Patent No.: US 7,062,870 B1
(45) Date of Patent: Jun. 20, 2006

(54) ELECTRIC FLATIRON WITH POWER CORD EASILY WOUND UP

(76) Inventor: Turning You, 21D, 2, Wuhan Building, No. 265 Jiahe Road, Xiamen (CN) 361000

( * ) Notice: Subject to any disclaimer, the term of this patent is extended or adjusted under 35 U.S.C. 154(b) by 0 days.

(21) Appl. No.: 11/033,338

(22) Filed: Jan. 11, 2005

(51) Int. Cl.
*D06F 75/30* (2006.01)

(52) U.S. Cl. ..... 38/88

(58) Field of Classification Search ..... 38/74, 38/77.4, 88, 89, 90, 91, 92, 95; 242/376, 242/377, 382, 378.2; 219/245, 256; D32/68–72; 248/51

See application file for complete search history.

(56) References Cited

U.S. PATENT DOCUMENTS 853,238 A * 5/1907 Groash ..... 242/378.2
2,108,111 A * 2/1938 Ehrlich ..... 219/256
D157,605 S * 3/1950 Krause ..... D24/214
3,111,753 A * 11/1963 Seibold ..... 30/34.05
3,593,442 A * 7/1971 Davidson et al. ..... 38/79
4,517,757 A * 5/1985 Asada et al. ..... 38/88
4,585,194 A * 4/1986 Schwob ..... 248/52
5,784,800 A * 7/1998 Santhouse et al. ..... 34/97
6,431,500 B1 * 8/2002 Jacobs et al. ..... 248/51

* cited by examiner

*Primary Examiner*—Ismael Izaguirre
(74) *Attorney, Agent, or Firm*—Greer, Burns & Crain, Ltd.

(57) ABSTRACT

An electric flatiron with power cord easily winded up includes a flatiron body which has a base plate and inside an electric heater which heats the base plate, the electric heater is connected with a power cord which extends out of the flatiron body. A hand grip portion is formed upon the flatiron body, the space between the hand grip portion and the flatiron body is used for winding up the power cord. The present invention breaks through the structural design of traditional electric flatiron and abandons the structure of traditional handle. The present invention create a creative design that provides a winding portion between the handle and the flatiron body, which ingeniously makes the handle and the winding up apparatus a integral part and fully utilizes the space between the handle and the flatiron body. Winding apparatus in this design may be easily used and hardly deteriorate.

10 Claims, 2 Drawing Sheets

ELECTRIC FLATIRON WITH POWER CORD EASILY WOUND UP

FIELD OF THE INVENTION

The present invention generally relates to the connection, protection, and support to an electric flatiron power cord, in particular, to an electric flatiron with a power cord easily wound up.

BACKGROUND TECHNOLOGY

Electric flatirons or electric irons are commonly used in people's daily lives, but there is a reoccurring problem of rolling up the power cord. In order to solve this problem, in the prior art, a winding apparatus is disposed at the rear of the electric flatiron. This winding apparatus includes a winding box, the central portion of which is a winding shaft which is sleeved with a rotor plate used for winding the power cord.

Wherein, the rotor plate may rotate relatively to the winding shaft. In order to connect the electricity, the power cord must be connected to the heating component inside the electric flatiron through the rotor plate and winding shaft, wherein many problems of the electric connection between components should be considered. In order to enable the winding shaft to roll back the power cord automatically, a coil spring which could force the rotor plate to rotate along the winding direction of the power cord should be set on the winding shaft. Meanwhile, a clip which could lock the power cord in pulled-out position should also be set, but these components may easily deteriorate when repeatedly used. When pulling the power cord out from the winding apparatus, there should be enough force to overcome the force of the coil spring, and after being released from a locked position, the power cord immediately winds back under the force of the coil spring. The process of pulling out and winding back the power cord may easily cause related components to deteriorate.

Obviously, the existing winding apparatus of electric flatiron is complex, with high costs, and apt to break down.

In addition, the use of the winding apparatus makes the volume of the electric flatiron bigger. A handle is usually disposed upon the flatiron body, the space between the handle and the flatiron body is undesirably wasted. Therefore, electric flatiron of this kind is unreasonable in space design, which can not utilize space well.

BRIEF SUMMARY OF THE INVENTION

The purpose of the present invention is to create an electric flatiron with a power cord easily wound up which corrects the unreasonable design of the prior art winding-up apparatus and the handle which make the electric flatiron have a complex structure, high costs, a huge volume and be apt to break down.

The solution presented in this invention is: an electric flatiron with a power cord easily wound up, which comprises a flatiron body which has a base plate inside an electric heater which heats the base plate. The electric heater is connected with a power cord which extends out of the body. A hand grip portion is disposed upon the flatiron body, the space between the hand grip portion and the flatiron body could be used for winding up the power cord.

The above mentioned hand grip portion is disk-like body, which is connected to the flatiron body by a winding post, which has a bigger diameter in both ends and a smaller diameter in the middle. The outer surface of the winding post is a slick covered surface. This surface, in company with the bottom surface of the hand grip portion of the top surface of the flatiron body, define the space used for winding up the power cord.

The top above mentioned flatiron body subsides slightly forming a sunken surface.

The related power cord extends out from the rear of the flatiron body, a clip used for lock the power cord is set on the top front portion of the flatiron body.

The related hand grip portion includes a temperature controlling knob, which controls the temperature of the electric heater. The temperature controlling knob embedded into the top portion of the hand grip portion.

One aspect of the present invention is an electric flatiron with a power cord easily wound up, which has a hand grip portion upon its body. In the approximate middle of the hand grip portion, there is a connecting portion connected to the flatiron body. Thus, there is no preformed space needed for fingers to cross through the above flatiron body, which helps the structural design.

Another aspect is an electric flatiron with a power cord easily wound up which has a hand grip portion. The hand grip portion may be designed in any suitable size and shape, e.g. like a mouse used with a computer.

Still another aspect is that in traditional flatirons, to be practical, there must be preformed space between the hand grip portion upon the flatiron body for hands to properly grip the hand grip portion. As a result, this limits the structural design of the electric flatiron, and the designer has to define space above the flatiron body for fingers to cross through when gripping the handle.

The present invention breaks through the structural design of traditional electric flatirons and abandons the structure of the traditional handle. The present invention creates a creative design that provides a winding portion between the handle and the flatiron body, which ingeniously makes the handle and the winding up apparatus an integral part and fully utilizes the space between the handle and the flatiron body. The present winding apparatus may be easily used and is long-lasting. In addition, the present invention changes the traditional structure of a preformed space between the handle and the flatiron body, and the hand grip portion is designed like that of a computer mouse, in accordance with modern aesthetic conceptions.

BRIEF DESCRIPTION OF THE DRAWINGS

The present invention will be described with greater specificity and detail through the use of the accompanying drawings, in which.

DETAILED DESCRIPTION OF THE PREFERRED EMBODIMENTS

Figure 1:
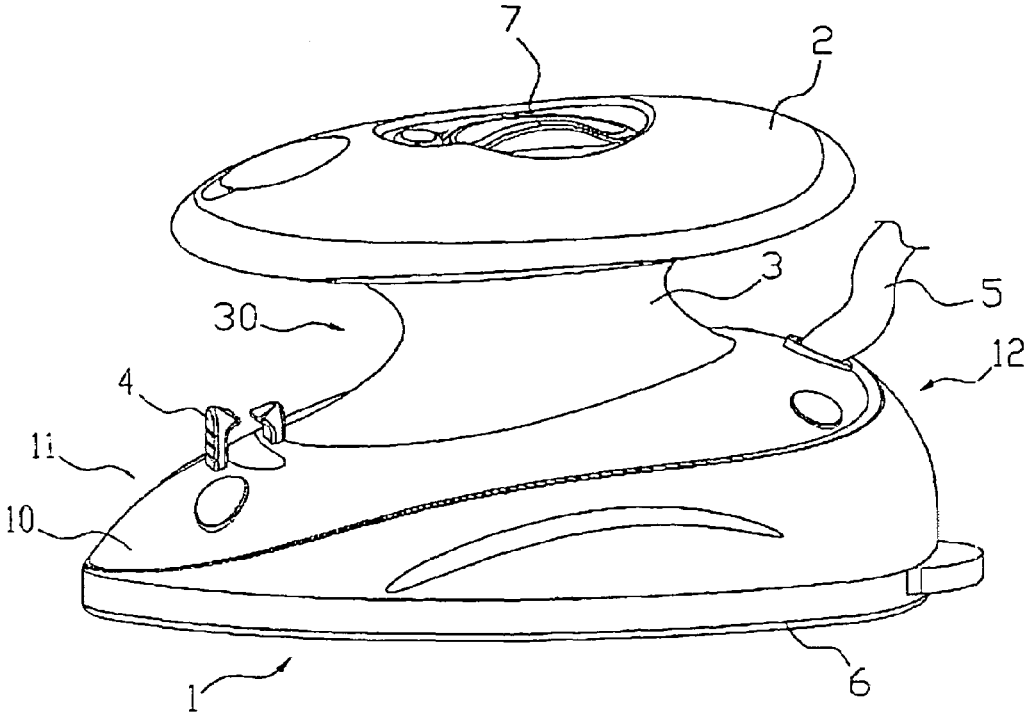
FIG. 1 is an exploded view of an electric flatiron with a power cord easily wound up, illustrating the power cord is not wound up.
Figure 2:
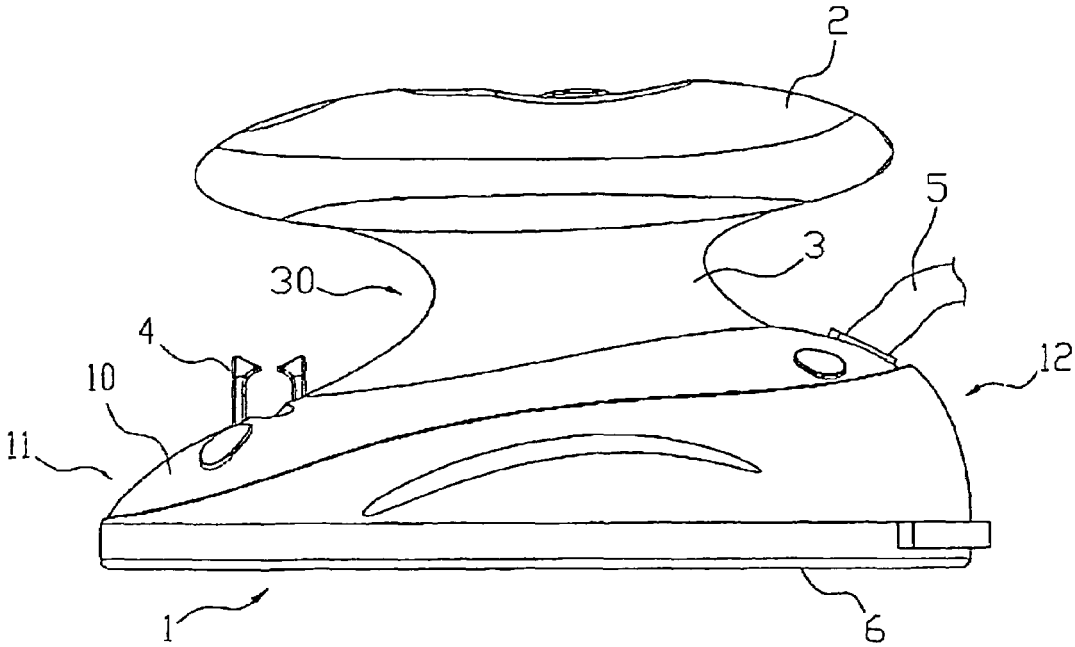
FIG. 2 is a principal view of an electric flatiron with a power cord easily wound up, illustrating the power cord not wound up.
Figure 3:
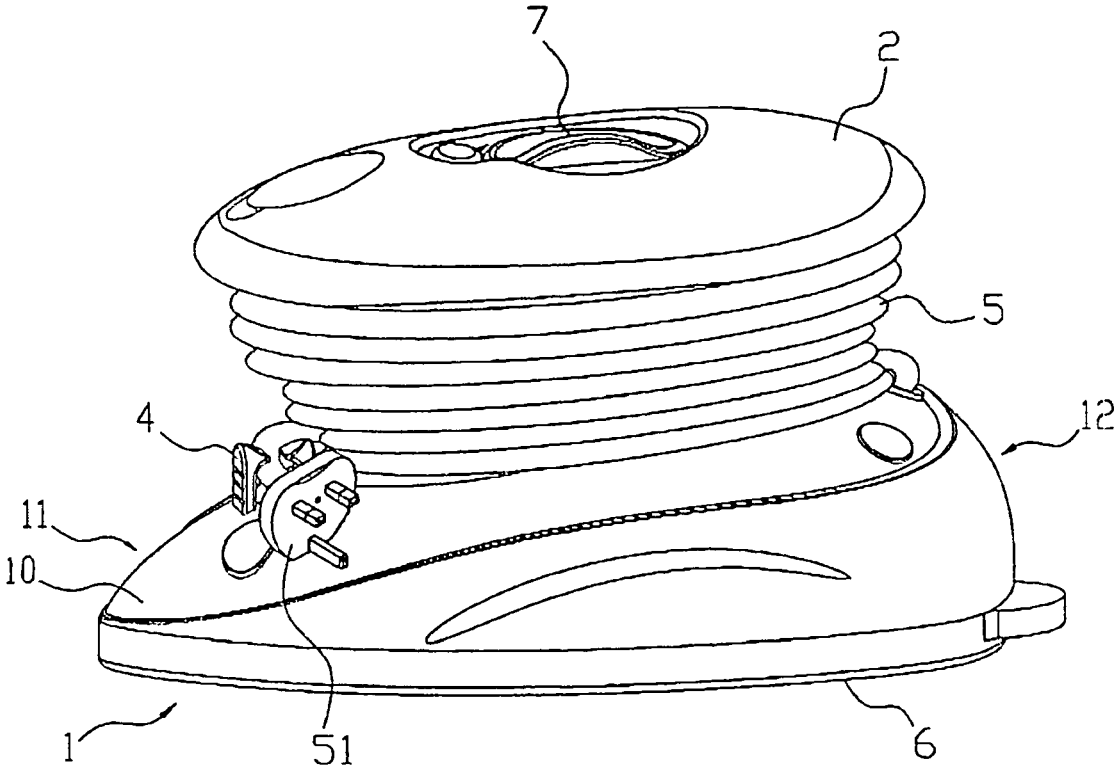
FIG. 3 is an exploded view of an electric flatiron with a power cord easily wound up, illustrating the power cord is wound up.

With reference to FIGS. 1, 2 and 3, an electric flatiron with a power cord easily wound up, includes a flatiron body 1 which has a base plate 6 and an internal electric heater (not shown) which heats the base plate 6. The electric heater is connected to a power cord 5 which extends out of the body. The top portion of the flatiron body 1 subsides slightly forming a sunken surface 10. A hand grip portion 2 is provided above the sunken surface 10. The hand grip portion 2 is a disk-like body, which is connected to the center of the sunken surface 10 of the flatiron body 1 by a winding post 3 which has a larger diameter in both upper and lower ends and a smaller diameter in the middle. The outer surface of the winding post 3 is slick and curved. This surface in company with the bottom surface of the hand grip portion 2 and the top surface of the flatiron body 1 define the space 30 used for winding up the power cord 5. The power cord 5 extends out from the rear 12 of the flatiron body 1, and a clip 4 used to lock the power cord 5 is set on the top front portion 11 of the flatiron body 1. With reference to FIG. 3, the power cord 5 is wound up within the space 30 and an end portion near the plug 51 is locked by the clip 4.

The hand grip portion 2 on its top includes a temperature controlling knob 7 which controls the temperature of the electric heater. The temperature controlling knob 7 is embedded into the top portion of the hand grip portion 2, which does not influence gripping the hand grip portion 2.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

The invention claimed is:

1. An electric flatiron with power cord easily wound up comprising:

a flatiron body having a base plate;

an electric heater inside said flatiron body heating said base plate;

a power cord connected to said electric heater and extending out of said flatiron body;

a hand grip portion connected to said flatiron body by a winding post;

said hand grip portion being a disk-like body;

said winding post having a larger diameter at its two axial ends and a smaller diameter at its midpoint;

said smaller diameter being circumferentially continuous;

said winding post having a curved surface;

said hand grip portion, said curved surface and said flat iron body defining a space used for winding up the power cord.

2. The electric flatiron of claim 1, wherein the top of the flatiron body subsides slightly, forming a sunken surface.

3. The electric flatiron of claim 1, wherein the power cord extends out from the rear of the flatiron body, a clip used for locking the power cord is set on the top front portion of the flatiron body.

4. The electric flatiron of claim 1, wherein the hand grip portion on its top includes a temperature controlling knob which controls the temperature of the electric heater, said temperature controlling knob embeds into the top portion of the hand grip portion.

5. An electric flatiron with power cord easily wound up comprising:

a flatiron body having a base plate;

an electric heater located inside said body heating said base plate;

said electric heater having a power cord extending out of said flatiron body;

wherein a hand grip portion is formed above the flatiron body and a connecting component in the approximate middle of the hand grip portion connects the hand grip portion to the flatiron body.

6. The electric flatiron of claim 5, wherein the space between the hand grip portion and the flatiron body is used for winding up the power cord.

7. The electric flatiron of claim 5, wherein a clip used for locking the power cord is located on the top front portion of the flatiron body.

8. The electric flatiron of claim 5, wherein the hand grip portion is designed in the shape of a flat ellipsoid.

9. An electric flatiron with power cord easily wound up comprising:

a flatiron body having a base plate;

an electric heater inside said flatiron body heating said base plate;

a power cord connected to said electric heater and extending out of said flatiron body;

a hand grip portion connected to said flatiron body by a winding post;

said hand grip portion being a disk-like body;

said winding post having a larger diameter at its two axial ends and a smaller diameter at its midpoint;

said smaller diameter being circumferentially continuous;

said winding post having a curved surface;

said hand grip portion, said curved surface and said flat iron body defining a space used for winding up the power cord;

where the top of the flatiron body subsides slightly, forming a sunken surface and the power cord extends out from the rear of the flatiron body, a clip used for locking the power cord is set on the top front portion of the flatiron body.

10. The electric flatiron of claim 9 wherein said clip is located on said sunken surface and includes a pair of spaced fingers projecting vertically from an upper surface of said surface.

* * * * *